United States Patent [19]

Lehner

[11] Patent Number: 5,044,235

[45] Date of Patent: Sep. 3, 1991

[54] FILAMENT CUTTING MACHINE SYSTEM

[75] Inventor: Peter Lehner, Hingham, Mass.

[73] Assignee: Leigh Fibers, Inc., Norwell, Mass.

[21] Appl. No.: 488,273

[22] Filed: Mar. 2, 1990

[51] Int. Cl.[5] ..... B26D 1/00

[52] U.S. Cl. ..... 83/13; 83/19; 83/425.2; 83/856; 83/857; 241/95

[58] Field of Search ..... 83/13, 19, 176, 425.2, 83/431, 856, 857; 241/93, 95, 101.4; 144/193 A, 193 E; 100/98 R, 188

[56] References Cited

U.S. PATENT DOCUMENTS

| | | | |
|---|---|---|---|
| 590,129 | 9/1897 | Bulette | 83/857 |
| 2,535,261 | 12/1950 | Brown | 83/425.2 |
| 3,105,643 | 10/1963 | Todd | 241/95 |
| 3,530,751 | 9/1970 | Munroe . | |
| 4,006,277 | 2/1977 | Laird . | |
| 4,078,591 | 3/1978 | Syrjala | 144/193 A |
| 4,763,574 | 8/1988 | Ast . | |

*Primary Examiner*—W. Donald Bray

*Attorney, Agent, or Firm*—Hamilton, Brook, Smith & Reynolds

[57] ABSTRACT

A method and apparatus are disclosed for forming a stream of cut filaments from a source of tangled, non-oriented filaments. A feeder ram is movable between a feed position and a load position for directing filaments from the source of non-oriented filaments into interfering relation with advancement of a cutter ram. The cutter ram is movable between a load position and a cut position for directing at least a portion of the filaments, which are in interfering relation with advancement of the cutter ram, against at least two blades. Fibers directed against the blades are cut to form, with remaining filaments which are not cut, a stream of cut filaments. The blades can be configured for continuous sharpening of blade edges during cutting.

8 Claims, 3 Drawing Sheets

FILAMENT CUTTING MACHINE SYSTEM

BACKGROUND OF THE INVENTION

Filaments reclaimed from textile wastes are often shredded for use as filler, insulation, or pressed mats of fibrous material Filaments from wastes produced by fiber producers and textile plants form a source of tangled, or non-oriented, filaments which can be cut for further processing. Alternating motion of blades through non-oriented filaments can cause irregularity of filament segments cut from a source of such filaments. Further, blades used to cut filaments often tend to wear rapidly because of contact of the blade edge with other apparatus parts during cutting. Apparatus for cutting filaments which operate by alternating motion of blades can also cause the apparatus to become clogged.

Thus, a need exists for an improved cutting method and apparatus for forming a stream of filaments which overcomes or minimizes the aforementioned problems.

SUMMARY OF THE INVENTION

The present invention relates to a method and apparatus of forming a stream of cut filaments from a source of non-oriented filaments.

A method of forming a stream of cut filaments includes advancing a feeder ram from a feed position to a load position to direct filaments from a source of non-oriented filaments into interfering relation with advancement of a cutter ram. The cutter ram is then advanced across the feeder ram face from a load position to a cut position. At least a portion of the filaments which are in interfering relation with advancement of the cutter ram are directed by the cutter ram against a blade and are cut by the blade. The cutter ram is then retracted for receiving filaments from the source of non-oriented filaments into interfering relation with advancement of the cutter ram. The feeder ram is then retracted from the load position to the feed position and non-oriented filaments are received from the non-oriented fiber source into interfering relation with the feeder ram. The feeder ram is then advanced, thereby directing filaments which are in interfering relation with the feeder ram into interfering relation with advancement of the cutter ram. The feeder ram and the cutter ram are repeatedly advanced and retracted to form a stream of cut filaments.

Apparatus for forming a stream of substantially aligned filaments includes a feeder ram movable between a feed position and a load position, a cutter ram movable between a load position and a cut position, and a blade disposed opposite advancement of the cutter ram from the load position to the cut position. The feeder ram advances from the feed position to the load position to direct substantially non-oriented filaments from a source of non-oriented filaments into interfering relation with advancement of the cutter ram. The cutter ram advances from the load position to the cut position to direct at least a portion of the filaments which are in interfering relation with advancement of the cutter ram against the blade. The filaments directed against the blade are thereby cut and, with the remaining filaments which are not cut, form a stream of cut filaments.

Cut filaments within the stream of cut filaments enable attenuation of filaments while maintaining cohesiveness of the stream, thereby allowing formation of a continuous stream of filaments which are substantially parallel. The blade does not alternate and therefor clogging of the apparatus is minimized. Further, blade wear is reduced because the blade contacts only filaments to be cut.

DETAILED DESCRIPTION OF THE DRAWINGS

DETAILED DESCRIPTION OF THE INVENTION

The above features and other details of the method and apparatus of the invention will now be more particularly described with reference to the accompanying drawings and pointed out in the claims. It will be understood that the particular embodiments of the invention are shown by way of illustration and not as a limitation of the invention. The principle features of this invention may be employed in various embodiments without departing from the scope of the invention.

Figure 1:
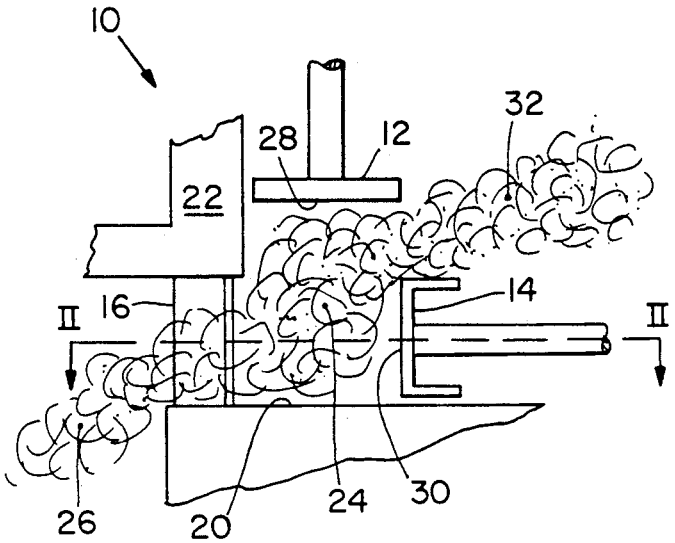
FIG. 1 is a section view of a first embodiment of the present invention wherein a feeder ram is in a feed position and a cutter ram is in a load position.
Figure 2:
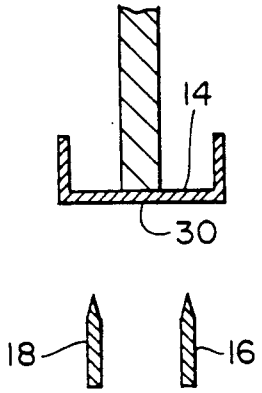
FIG. 2 is a section view of the embodiment of FIG. 1 taken along line II—II.

Cutting machine system 10, shown in FIG. 1, forms a stream of cut filaments from a source of non-oriented filaments. Feeder ram 12 is movable and directs filaments into interfering relation with advancement of cutter ram 14 toward blades 16,18, shown in FIG. 2. Blades 16,18 are supported between wall 20 and support 22, as seen in FIG. 1. At least a portion of non-oriented filaments 24 which are in interfering relation with advancement of cutter ram 14 are directed by cutter ram 14 against blades 16,18 and are cut at blades 16,18 to form a stream 26 of cut filaments.

Apparatus for forming a stream of cut filaments includes a cutting machine system 10, having a feeder ram 12, cutter ram 14 and blades 16,18. Feeder ram 12 has a feeder ram face 28 and cutter ram 14 has a cutter ram face 30. A source 32 of non-oriented filaments is adjacent feeder ram 12.

Figure 3:
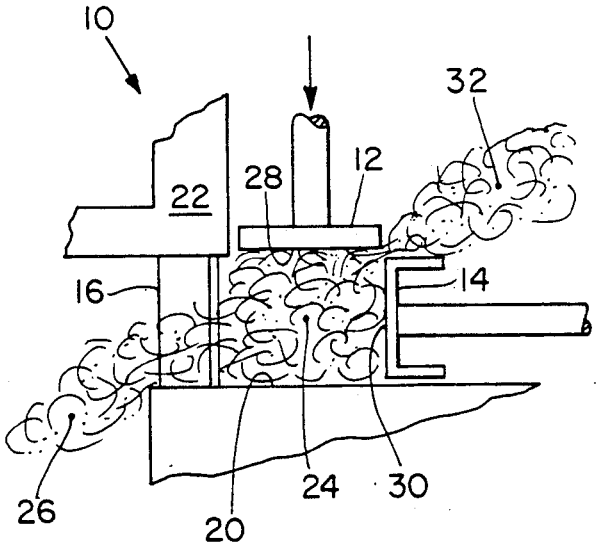
FIG. 3 is section view of the embodiment of FIG. 1 wherein the feeder ram is in a load position.
Figure 4:
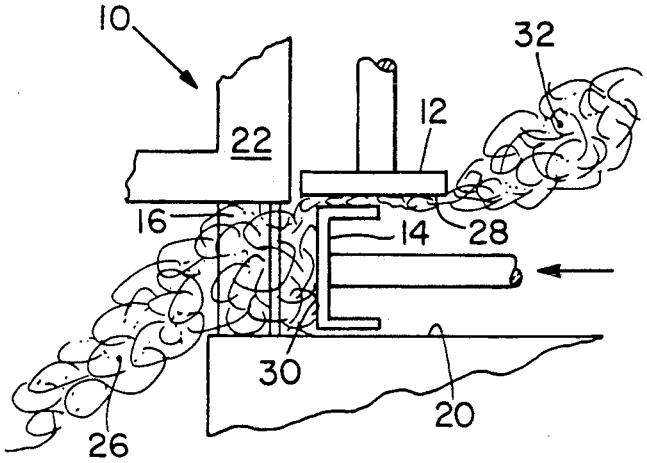
FIG. 4 is a section view of the embodiment of FIG. 1 wherein the cutter ram is in a cut position.

Feeder ram 12 is movable between a feed position, shown in FIG. 1, and load position, shown in FIG. 3. Cutter ram 14 is movable between a load position, shown in FIGS. 1 and 3, and a cut position, shown in FIG. 4. Feeder ram 12 advances from the feed position to the load position to direct filaments from source 32 into interfering relation with advancement of cutter ram 14 from the load postion to the cut position. Blades 16,18 are disposed opposite advancement of cutter ram 14. Advancement of cutter ram 14 directs at least a portion of filaments 24 against blades 16,18, whereby they are cut to form, with remaining uncut filaments, a stream 26 of cut filaments.

A method for forming a stream of cut filaments received from a source 32 of non-oriented filaments includes advancement of feeder ram 12 from a feed position to a load position to thereby direct filaments from source 32 of non-oriented filaments, which are proximate to feeder ram face 28, into interfering relation with advancement of cutter ram 14. Non-oriented filaments can be directed into interfering relation with advancement of feeder ram 12 from source 32 by gravity through a feed apron or feed slide, not shown, or by some other conventional means. While feeder ram 12 is in the load position, cutter ram 14 is advanced from the load position to the cut position and thereby passes across feeder ram face 28. The path of advancement of cutter ram 14 can be substantially parallel to feeder ram face 28.

Figure 5:
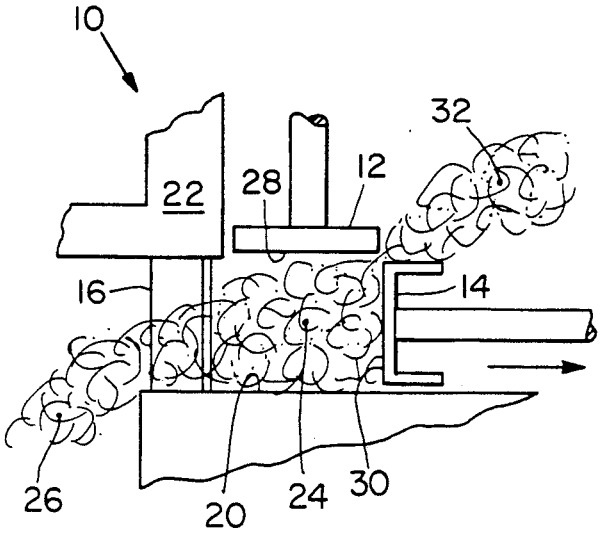
FIG. 5 is a section view of the embodiment of FIG. 1 wherein the cutter ram has retracted from the cut position to the load position, thereby causing non-oriented filaments to enter a cutting chamber.

At least a portion of filaments 18 from source 32 which are in interfering relation with advancement of feeder ram 12 are directed by cutter ram 14 against blades 16,18 as cutter ram 14 advances and are thereby cut by blades 16,18. Cutter ram 14 is advanced to the cut position shown in FIG. 4, and is then retracted to the feed position, as shown in FIG. 5.

Retraction of cutter ram 14 to the load position allows filaments from source 32 to be received into interfering relation with subsequent retraction of feeder ram 12. Feeder ram 12 is then retracted from the load position, shown in FIG. 3, to the feed position, shown in FIG. 1, for receiving additional non-oriented filaments from source 32 at feeder ram face 28. In a preferred embodiment of the invention, a line of travel of cutter ram 14 defined by the load position and the cut position of cutter ram 14 is substantially perpendicular to a line of travel of feeder ram 12 defined by the feed position and the load position of feeder ram 12.

Feeder ram 12 is advanced to direct filaments into interfering relation with advancement of cutter ram 14, and then cutter ram 14 is advanced from the load position to the cut position to cut at least a portion of filaments 24 which are in interfering relation with advancement of cutter ram 14.

Repeated advancement and retraction of feeder ram 12 and cutter ram 14 can thereby cut filaments received from source 32 of non-oriented filaments to form a stream 26 of cut filaments. Stream 26 of cut filaments can be conducted away from cutting machine system 10 along a slide, not shown, to a conveyer belt or feed rolls, also not shown, for at least partially aligning filaments in stream 26. A continuous stream of substantially aligned filaments is thereby formed prior to further processing of stream 26, such as transverse cutting of stream 26 into segments.

Figure 6:
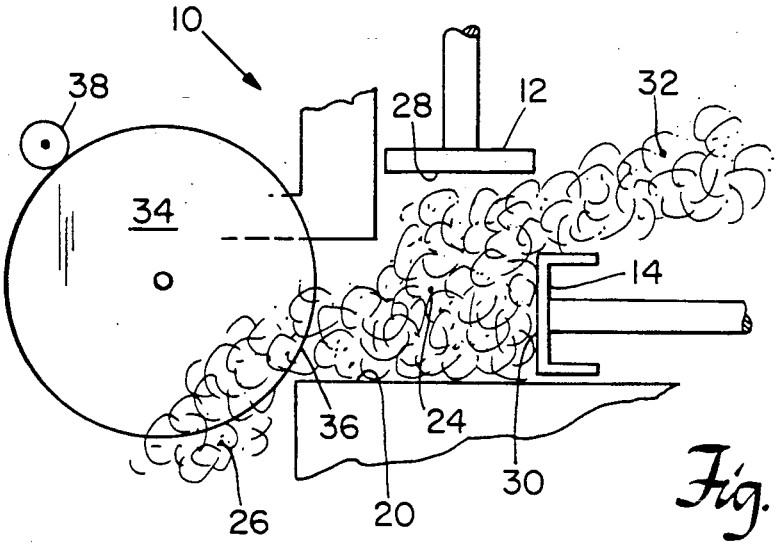
FIG. 6 is a section view of a second embodiment of the present invention, having a rotating, self-sharpening blade.

In another embodiment of the present invention, shown in FIG. 6, a rotating disk 34 is located opposite cutter ram face 24. Edge 36 of rotating disk 34 can be sharpened by blade sharpener 38 which is disposed in non-interfering relation to advancement of cutter ram 14. Rotating blade 34 can be rotated by a motor, not shown, for continuously presenting a newly sharpened edge 36 to filaments in interfering relation to advancement of cutter ram 14.

Figure 7:
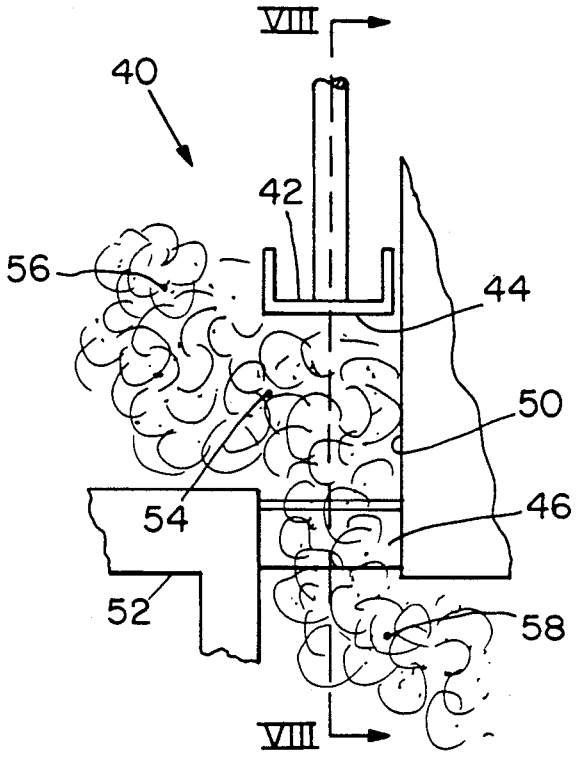
FIG. 7 is a section view of a third embodiment of the present invention wherein a cutter ram is in a load position.

In still another embodiment of the present invention, shown in FIG. 7, cutting machine system 40 has a cutter ram 42 which is movable. Cutter ram face 44 at cutter ram 42 is disposed opposite blades 46,48, shown in FIG. 8. Blades 46,48 are supported between wall 50 and support 52, as seen in FIG. 7. At least a portion of non-oriented filaments 54, from a source 56 of non-oriented filaments, are directed into interfering relation with advancement of cutter ram 42. Cutter ram 42 directs non-oriented filaments 54 against blades 46,48. Non-oriented filaments 54 are thereby cut at blades 46,48 to form, with remaining uncut filaments, a stream 58 of cut filaments.

Figure 8:
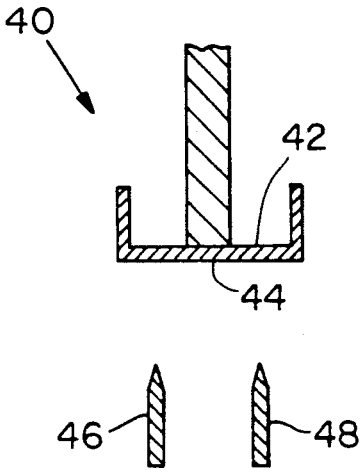
FIG. 8 is a section view of the embodiment of FIG. 7 taken along lines VIII—VIII.
Figure 9:
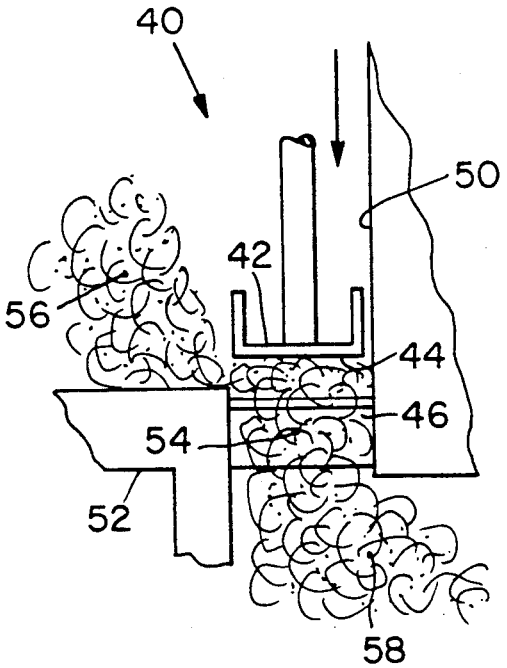
FIG. 9 is a section view of the embodiment of FIG. 7 wherein the cutter ram is in a cut position.

Apparatus for forming a stream 58 of cut filaments from a source 56 of non-oriented filaments, includes a cutter ram 42 which is movable between a load position, shown in FIG. 7, and a cut position, shown in FIG. 9. Blades 46,48, shown in FIG. 8, are disposed opposite advancement of cutter ram 42 from the load position to the cut position. Advancement of cutter ram 42 directs at least a portion of filaments 54, shown in FIGS. 7 and 9, which are in interfering relation with advancement of cutter ram 42, against blades 46,48, shown in FIG. 8, whereby filaments 54 are cut to form, with remaining uncut filaments, a stream 58 of cut filaments.

Cutter ram 42 is then retracted from the cut position to the load position for receiving filaments from source 56 of non-oriented filaments into interfering advancement of cutter ram 42. Subsequent advancement of cutter ram 42 will cut at least a portion of the filaments received into interfering relation with advancement of cutter ram 42 and form, with remaining filaments which are not cut, a stream 58 of cut filaments.

EQUIVALENTS

Although preferred embodiments have been specifically described and illustrated herein, it will be appreciated that many modifications and variations of the present invention are possible, in light of the above teachings, within the purview of the following claims, without departing from the spirit and scope of the invention.

I claim:

1. Apparatus for forming a stream of cut filaments from a source of non-oriented filaments comprising:
   a) a feeder ram movable between a feed position and a load position;
   b) a cutter ram movable between a load position and a cut position, whereby the feeder ram directs substantially non-oriented filaments from a source of non-oriented filaments into interfering relation with advancement of the cutter ram by advancement of the feeder ram from the feed position to the load position; and
   c) at least two blades disposed opposite advancement of the cutter ram from the load position to the cut position, whereby advancement of the cutter ram directs at least a portion of the filaments, which are in interfering relation with advancement of the cutter ram, against the blades, and whereby the filaments directed against the blade are cut, the cut filaments and the remaining filaments which are not cut thereby forming a stream of cut filaments.

2. An apparatus of claim 1, wherein the load position and the cut position of the cutter ram define a line of travel which is substantially perpendicular to a line of travel of the feeder ram defined by the feed position and the load position of the feeder ram.

3. An apparatus of claim 2, further including a feeder ram face at the feeder ram, and a cutter ram face at the cutter ram, whereby the cutter ram face advances against filaments in interfering relation with advancement of the feeder ram to direct non-oriented filaments from a source of non-oriented filaments into interfering relation with advancement of the cutter ram, and whereby the cutter ram face advances against filaments in interfering relation with advancement of the cutter ram to direct at least a portion of said filaments against the blades, said filaments thereby being cut to form, with remaining filaments which are not cut, a stream of cut filaments.

4. An apparatus of claim 3, wherein the blades are circular and whereby the blades rotate for self-sharpening of the blades during cutting of substantially aligned filaments.

5. A method of forming a stream of substantially aligned filaments from a source of non-oriented filaments comprising the steps of:

a) advancing a feeder ram from a feed position to a load position, thereby directing filaments from the source of non-oriented filaments into interfering relation with advancement of a cutter ram;

b) advancing the cutter ram from a load position to a cut position, whereby the cutter ram passes across the feeder ram to direct at least a portion of the filaments which are in interfering relation with advancement of the cutter ram against at least two blades, whereby the filaments are cut by the blades;

c) retracting the cutter ram from the cut position to the load position for receiving filaments from the source of non-oriented filaments into interfering relation with advancement of the cutter ram, whereby subsequent advancement of the cutter ram will cut at least a portion of the filaments; and d) retracting the feeder ram from the load position to the feed position for receiving the filaments into interfering relation with advancement of the feeder ram, whereby repeated advancement and retraction of the feeder ram and the cutter ram cuts at least a portion of the filaments to form, with remaining filaments which are not cut, a stream of cut filaments.

6. A method of claim 5, further including the step of rotating the blades, whereby the blades are sharpened while presenting consistently sharpened blade edges for cutting of the filaments.

7. A method of claim 6, wherein the blades are self-sharpened.

8. A method of forming a stream of cut filaments from a source of non-oriented filaments comprising the steps of:

a) advancing a cutter ram from a load position to a cut position, whereby the cutter ram directs at least a portion of substantially non-oriented filaments, which are in interfering relation with advancement of the cutter ram, against at least two blades, and whereby the filaments directed against the blades are cut; and b) retracting the cutter ram from the cut position to the load position for receiving filaments from a source of non-oriented filaments into interfering relation with advancement of the cutter ram, whereby subsequent advancement of the cutter ram will cut at least a portion of the filaments to form, with remaining filaments which are not cut, a stream of cut filaments.

* * * * *